US005813398A

United States Patent [19]

Baird et al.

[11] Patent Number: 5,813,398

[45] Date of Patent: Sep. 29, 1998

[54] COMBINED ANTI FOG AND ANTI GLARE FEATURES FOR FACE MASKS

[75] Inventors: Derek W. Baird, Colleyville; Kevin K. Brunson, Argyle, both of Tex.

[73] Assignee: Tecnol Medical Products, Inc., Fort Worth, Tex.

[21] Appl. No.: 828,252

[22] Filed: Mar. 26, 1997

Related U.S. Application Data

[60] Provisional application No. 60/014,747 Mar. 29, 1996.

[51] Int. Cl.[6] ..... A62B 18/08; A62B 7/00; A62B 23/02

[52] U.S. Cl. ..... 128/201.17; 128/201.15; 128/206.13; 128/206.19; 128/206.23

[58] Field of Search ..... 128/201.15, 201.17, 128/206.13, 206.19, 206.23

[56] References Cited

U.S. PATENT DOCUMENTS

| | | | |
|---|---|---|---|
| 3,888,246 | 6/1975 | Lauer . | |
| 3,890,966 | 6/1975 | Aspelin et al. . | |
| 3,974,829 | 8/1976 | Tate, Jr. . | |
| 4,037,593 | 7/1977 | Tate, Jr. | 128/201.17 |
| 4,300,549 | 11/1981 | Parker . | |
| 4,323,063 | 4/1982 | Fisichella . | |
| 4,419,993 | 12/1983 | Petersen . | |
| 4,635,628 | 1/1987 | Hubbard et al. . | |
| 4,662,005 | 5/1987 | Grier-Idris . | |
| 4,688,566 | 8/1987 | Boyce . | |
| 4,802,473 | 2/1989 | Hubbard et al. . | |
| 4,920,960 | 5/1990 | Hubbard et al. . | |
| 4,966,140 | 10/1990 | Herzberg | 128/206.13 |
| 5,020,533 | 6/1991 | Hubbard et al. . | |
| 5,303,423 | 4/1994 | Gazzara et al. . | |
| 5,322,061 | 6/1994 | Brunson . | |

*Primary Examiner*—Mickey Yu
*Assistant Examiner*—Dinh X. Nguyen
*Attorney, Agent, or Firm*—Dority & Manning, P.A.

[57] ABSTRACT

A face mask having a filter body for covering the nose and mouth of a wearer. Ear loops, head bands, surgical ties and other appropriate devices may be used to secure the face mask to the face of the wearer. The filter body is preferably formed from one or more layers of non-woven material. A fluid impervious film layer is attached to an exterior portion of the filter body to prevent fogging of eye glasses or an eyepiece for scientific equipment. A non-woven material layer may be placed over the fluid impervious film to minimize or eliminate glare and reflections from the mask. The non-woven material layer may also protect the fluid impervious film layer during fabrication of the associated mask. For some applications, one or more layers of darkened material may be placed on portions of the mask to reduce or eliminate reflections and glare. The layers of darkened material may be used as edge bindings or to cover the fluid impervious film. The fluid impervious film may have a colored tint or a matte finish to reduce reflection and glare, particularly if the non-woven material layer is not placed over the fluid impervious film.

11 Claims, 2 Drawing Sheets

COMBINED ANTI FOG AND ANTI GLARE FEATURES FOR FACE MASKS

TECHNICAL FIELD OF THE INVENTION

This application claims the benefit of U.S. provisional application No. 60/014,747 filed Mar. 29, 1996.

This invention relates in general to disposable protective equipment and more particularly to face masks with enhanced anti-glare and anti-fog characteristics.

BACKGROUND OF THE INVENTION

Wearing protective face masks has become standard procedure for many health care and other related activities. The use of a face mask is important, for example, to lab technicians while conducting tests, to nurses during the care of patients, to physicians during surgery and other medical treatment, and to dentists working in a patient's mouth.

Many industrial applications also require wearing protective equipment to reduce dust particles and other contaminants in the air as well as to protect the workers from possibly hazardous chemicals and/or bacteria. A clean room environment in which extensive precautions are taken to reduce dust particles and other contaminants in the air is frequently required for the assembly of advanced electronic equipment such as microprocessors or the manufacture of pharmaceutical products using advanced microbiology and genetic engineering techniques.

The rapid increase of infectious diseases, particularly AIDS, has made the use of protective equipment at medical facilities increasingly important. The Center for Disease Control in Atlanta, Georgia, has found that the AIDS virus (HIV) can be passed by contact with body fluids. Contact of AIDS contaminated body fluids with another person's source of body fluids, e.g., eyes, nose, mouth, etc., can pass the virus. Therefore, it is necessary to prevent a patient's body fluids from contacting the face of health care personnel.

During the past several years, health care personnel have become more aware of the potential hazards associated with airborne pathogens, such as the hepatitis B virus and infectious tuberculosis associated with many HIV patients. It has been found that aerosols having airborne liquid and solid particles are generated not only by the exhalation of infective patients, but also by certain procedural manipulations and processes that impart energy to microbial solutions. Also, many viral demographic fever such as yellow fever, rip valley fever and perhaps rocky mountains spotted fever, rabies and small pox can be transmitted through aerosols. A considerable number of studies have been made which are now beginning to identify the transmission of viruses through non accidental situations.

As a result of these concerns significant enhancements have been made for both medical applications and industrial applications to provide comfortable, low cost and effective face protection. Materials are available to allow the free passage of air through a face mask for breathing and to prevent the passage of bacteria, aerosols and/or liquids therethrough. Because operating room personnel and clean room personnel may be required to wear surgical face masks for extended periods of time, such masks must be comfortable and must be structured to not interfere with the breathing or the vision of the wearer.

An ever present problem attendant with the use of protective face masks in both medical and industrial applications is the warm, moist air exhaled by the wearer. Exhaled air has a tendency to fog or cloud glasses and eye pieces for scientific equipment such as endoscopes and microscopes. This fogging or clouding often results when a high concentration of moisture vapor contained within the protective mask passes through or around the mask and condenses on a cooler eye glass in the proximity of the mask.

Problems with fogging have been addressed in various patents such as U.S. Pat. No. 4,635,628 entitled "Surgical Face Mask with Improved Moisture Barrier"; U.S. Pat. No. 4,419,993 entitled "Anti-Fogging Surgical Mask"; U.S. Pat. No. 3,890,966 entitled "Anti-Fogging Surgical Face Mask with Slits"; and U.S. Pat. No. 3,888,246 entitled "Anti-Fog Surgical Face Mask."

Personnel working in clean rooms for extended periods of time and medical personnel performing lengthy, complex surgical procedures often report eye strain and eye fatigue from reflections and glare after wearing a face mask for extended periods of time. Eye fatigue from glare is particularly noticeable when using precision scientific equipment such as microscopes and endoscopes while wearing a face mask or other protective equipment to shield the wearer's face. U.S. Pat. No. 5,020,533 entitled "Face Mask with Liquid and Glare Resistant Visor" addresses some of these problems.

Each of the above mentioned patents is incorporated by reference for all purposes within this application.

SUMMARY OF THE INVENTION

In accordance with the present invention, a face mask is provided to substantially reduce or eliminate the shortcomings previously associated with surgical style face masks and other types of protective coverings for a wearer's face. A face mask incorporating teachings of the present invention substantially reduces or eliminates fogging of a wearer's eye glasses and/or an eye piece associated with equipment used by the wearer and, at the same time, substantially reducing or eliminating glare and reflections from the exterior surface of the face mask. As a result of the present invention, a face mask may be comfortably worn for extended periods of time without experiencing eye fatigue or eye strain, and without fogging of eye pieces and glasses by air exhaled during normal breathing of the wearer.

The present invention provides a face mask having a filter body with a layer of fluid impervious film disposed over an upper portion of the face mask to block air exhaled by the wearer through the filter body from fogging eye glasses and/or an eye piece. A layer of non-woven material is preferably placed over the fluid impervious film layer to substantially reduce and/or eliminate any glare from the fluid impervious film layer. The layer of non-woven material also protects the fluid impervious film layer during fabrication of the face mask and particularly during sonic bonding or heat bonding of the fluid impervious film layer with other material layers used to form the face mask.

Other aspects of the present invention include providing a face mask having a nose piece or malleable member formed from darkened material to minimize glare and reflections when the face mask is placed on the wearer's face. The nose piece or malleable member may be plastic coated, powder coated, anodized or stained to provide a dull, non-reflective surface. For some applications the fluid impervious film layer may be tinted or provided with a matte finish to further reduce glare, particularly when. The non-woven material layer is not placed over the fluid impervious film layer. For other applications the layer of non-woven material placed over the fluid impervious film layer may be formed from a darkened strip of material to further reduce or eliminate glare and reflections into the eyes of the wearer. Edge bindings which extend around the perimeter of the face mask may also be formed from strips of darkened material.

The present invention allows combining a darkened nose piece or malleable member, a fluid impervious film layer, a layer of non-woven material to protect the fluid impervious film layer and/or bindings formed from strips of darkened material to optimize performance and long term comfort while wearing face masks having a wide variety of filter body designs and configurations, veil guards, and other protective equipment.

BRIEF DESCRIPTION OF THE DRAWINGS

For a more complete understanding of the present invention and advantages thereof, reference is now made to the following description taken in conjunction with the accompanying drawings, in which.

DETAILED DESCRIPTION OF THE INVENTION

The preferred embodiments of the present invention and its advantages are best understood by referring to FIGS. 1–4 of the drawings, like numerals being used for like and corresponding parts of the various drawings.

Figure 1:
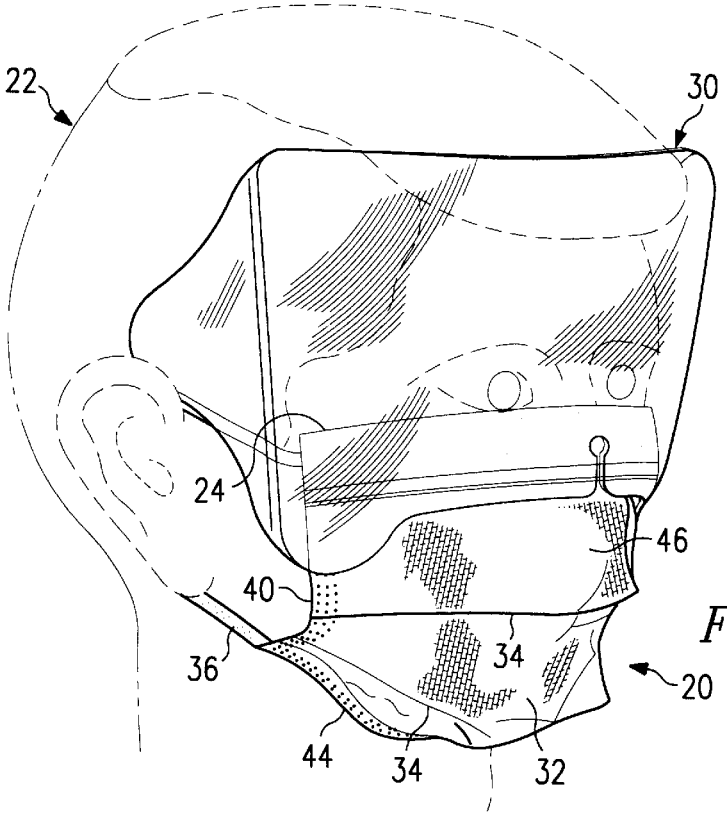
FIG. 1 is schematic drawing showing a perspective view of a face mask and visor incorporating teachings of the present invention illustrated on the head of a wearer.

Face mask 20, 120, 220 and 320, as shown in FIGS. 1–4, may be used to prevent the flow of bacteria, liquids and aerosols from the exterior of face mask 20, 120, 220 and 320 to the nose and mouth of a wearer. For the embodiment shown in FIG. 1, transparent visor 30 has been attached to face mask 20 to protect the eyes and other portions of the face of wearer 22 from liquid spray or splash. Visors satisfactory for use with the present invention are shown and described in U.S. Pat. No. 5,020,533. A face mask incorporating teachings of the present invention may be used with a wide variety of visors and is not limited to use with only visor 30 as shown in FIG. 1.

The present invention allows optimizing the fluid barrier formed between the perimeter of face mask 20 and the face of wearer 22 particularly adjacent to top edge 24 to prevent air exhaled by wearer 22 from fogging visor 30, eye glasses if worn by wearer 22, and/or an eye piece (not shown) associated with equipment being used by wearer 22. The present invention also allows optimizing various portions of the exterior of face mask 20 to minimize glare and reflections that may cause eye strain and eye fatigue for wearer 22. For many surgical procedures and clean room techniques, glare and/or reflections from a face mask may interfere with the operation of scientific equipment having an eye piece (not shown) such as a microscope or an endoscope or a laser sight for precision equipment.

Face mask 20, as shown in FIG. 1, includes filter body 32 having multiple pleats 34 to effectively cover the nose and mouth of wearer 22. For some applications, filter body 32 may be formed from multiple layers of non-woven material including an appropriate filter media to protect wearer 22 from bacteria and/or aerosols. Filter body 32 may include one or more layers of barrier material to prevent liquids from the exterior of face mask 20 from penetrating filter body 32 and contacting the face of wearer 22. U.S. Pat. No. 5,020,533 provides examples of various types of material that may be satisfactorily used to form filter body 32.

A pair of ear loops 36 and 38 are preferably attached to respective opposite side edges 40 and 42 of filter body 32 for use in securing face mask 20 over the nose and mouth of wearer 22. For some applications, ear loops 36 and 38 may be replaced by surgical ties or head bands. The present invention is not limited to use with only face masks having ear loops.

Face masks 20, 120, 220 and 320 incorporating various teachings of the present invention are particularly beneficial when combined with a visor such as visor 30 and/or when wearer 22 also wears eye glasses. Face masks 20, 120, 220 and 320 are also beneficial when wearer 22 uses equipment such as a microscope or an endoscope having an eye piece or a precision sight such as associated with laser fabricating techniques.

For purposes of illustrating various features of the present invention, face masks 20, 120, 220 and 320 are shown and described with respect to the same filter body 32. However, the present invention may be used with a wide variety of filter bodies and protective equipment to cover portions of a wearer's face. The present invention is not limited to the surgical style face masks shown in FIGS. 1–4.

Figure 2:
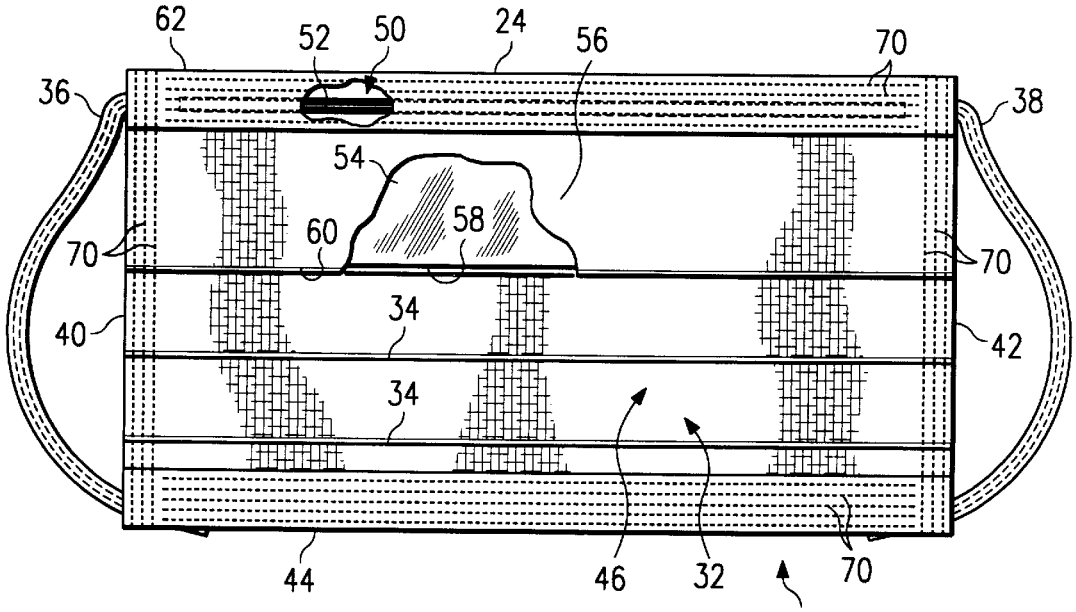
FIG. 2 is a schematic drawing showing an elevational view with portions broken away of the front or exterior of a face mask incorporating another embodiment of the present invention.

For the embodiment shown in FIG. 2, filter body 32 has a generally rectangular configuration defined in part by top edge 24 opposite side edges 40 and 42, and bottom edge 44. Filter body 32 includes exterior surface 46 and an interior surface (not expressly shown). Pleats 34 allow filter body 32 to bellow outwardly and easily conform to the general contours of the face of wearer 22. Pleats 34 cooperate with each other to allow filter body 32 to expand and contract during breathing of wearer 22 without compromising a fluid seal formed between the perimeter of filter body 32 and adjacent portions of the face of wearer 22. With increased concern for AIDS and other types of highly toxic bacteria and chemicals, personnel wearing face masks are particularly interested in preventing any fluid communication between the periphery of a face mask and adjacent portions of the wearer's face.

As best shown in FIG. 2, filter body 32 preferably includes nose piece or elongated malleable member 50 disposed adjacent to and extending along top edge 24. For one application, elongated malleable member 50 may be constructed from an aluminum strip with a generally rectangular cross section. Elongated malleable member 50 may also be formed from malleable steel or plastic. Malleable member 50 is used to conform top edge 24 with the contours of adjacent portions of the nose and cheeks of wearer 22. Blow by associated with normal breathing of wearer 22 may be substantially eliminated by properly selecting the material, dimensions and location of malleable member 50 with respect to top edge 24. Malleable member 50 not only prevents blow by from breathing of wearer 22, but also prevents fluids and aerosols from flowing around top edge 24 to bypass filter body 32.

Nose piece 50 preferably includes a dull, non-reflective exterior surface 52 to minimize glare and reflections from the exterior of face mask 120 into the eyes of wearer 22. The desired dull, non-reflective exterior surface 52 may be obtained by plastic coating or powder coating nose piece 50. Alternatively, nose piece 50 may be anodized or stained to provide the desired dull, non-reflective exterior surface 52.

A layer of fluid impervious film 54 is preferably disposed over exterior surface 46 of filter body 32 adjacent to top edge 24. Fluid impervious film layer 54 restricts moisture or vapor associated with breathing by wearer 22 from flowing upwardly to fog eye glasses if worn by wearer 22, or the eye piece of scientific equipment being use by wearer 22. Fluid impervious film layer 54 also prevents fogging of visor 30 when attached to face mask 20, 120, 220 or 320.

For many applications, filter body 32 is preferably formed from one or more layers of non-woven material which may be easily bonded to each other around the perimeter of filter body 32 by conventional heat sealing and/or sonic bonding techniques. The use of such non-woven materials and bonding techniques results in a highly efficient and economical face mask.

Fluid impervious film layer 54 may be formed from a wide variety of thin film plastic sheets such as polyethylene, polypropylene, polyvinyl chloride, or polyvinyl acetate. During some heat bonding or sonic bonding processes, an undesired residue may be produced when fluid impervious film layer 54 is bonded with adjacent portions of filter body 32. A layer of non-woven material 56 is preferably placed in juxtaposition with and covering fluid impervious film layer 54 prior to the bonding process. The use of non-woven material layer 56 often eliminates the undesired residue and results in improved efficiency of the associated bonding equipment. Heat seal bonding or sonic bonding of the various material layers associated with filter body 32 is highly desirable since such bonding techniques substantially reduce or eliminate any loose fibers along the edges of filter body 32. As will be discussed later in more detail, one or more edge bindings may also be placed around the perimeter of filter body 32. The same bonding techniques may also be used to attach ear loops 36 and 38 to their respective side edges 40 and 42 of filter body 32.

Fluid impervious film layer 54 and non-woven material layer 56 preferably have a generally rectangular configuration corresponding with the upper portion of filter body 32 adjacent to top edge 24. Fluid impervious layer 54 and non-woven material layer 56 each have a top edge that is preferably bonded with top edge 24 of filter body 32. Fluid impervious film layer 54 and non-woven material layer 56 also have opposite side edges extending from their respective top edge. The side edges of fluid impervious film layer 54 and non-woven material layer 56 are preferably bonded with adjacent portions of respective side edges 40 and 42 of filter body 32. As shown in FIG. 2, the length of the corresponding side edges of fluid impervious film layer 54 and non-woven material layer 56 are preferably less than the length of the respective side edges 40 and 42 of filter body 32.

Fluid impervious film layer 54 includes bottom edge 58 opposite from its associated top edge. Non-woven material layer 56 includes bottom edge 60 opposite from its respective top edge. For most applications, the width of non-woven material layer 56 as measured between its top edge and bottom edge 60, is preferably equal to or greater than the width of fluid impervious film layer 54 as measured between its top edge and bottom edge 58. Thus, when non-woven material layer 56 is placed in juxtaposition with and covering fluid impervious film layer 54, bottom edge 60 will be congruent with or extend over bottom edge 58.

Bottom edge 58 of fluid impervious film layer 54 and bottom edge 60 of non-woven material layer 56 are preferably not bonded with each other and are not bonded to adjacent portions of filter body 32. Thus, air can communicate between bottom edge 58 of fluid impervious film layer 54 and adjacent portions of filter body 32 during breathing of wearer 22. By bonding along the top edges and the side edges of fluid impervious film layer 54 and non-woven material layer 56, moisture and/or vapor are prevented from flowing upwardly from filter body 32 when wearer 22 exhales.

For some applications, non-woven material layer 56 is preferably formed from the same material used to form exterior surface 46 of filter body 32. For face mask 120 as shown in FIG. 2, non-woven material layer 56 is formed from the same material as exterior surface 46 of filter body 32. For other applications which will be discussed later in more detail, non-woven material layer 56 may be formed from darkened material to reduce glare and reflections from the exterior of face mask 120 into the eyes of wearer 22.

Filter body 32, as shown in FIG. 2, preferably includes first edge binding 62 extending along and folded over top edge 24 of filter body 32. The top edge of fluid impervious film layer 54 and the top edge of non-woven material 56 are sandwiched between first edge binding 62 and adjacent portions of exterior surface 46 of filter body 32. A plurality of heat bonds or sonic bonds 70 are formed between first edge binding 62 and adjacent portions of filter body 32. For some applications, first edge binding 62 may be replaced by increasing the width of non-woven material layer 56 and folding the excess material over top edge 24 of filter body 32 to perform the same function as first edge binding 62. For other applications, depending upon the types of material used to form filter body 32, fluid impervious film layer 54 and non-woven material layer 56, it may not be necessary to include first edge binding 62.

Figure 3:
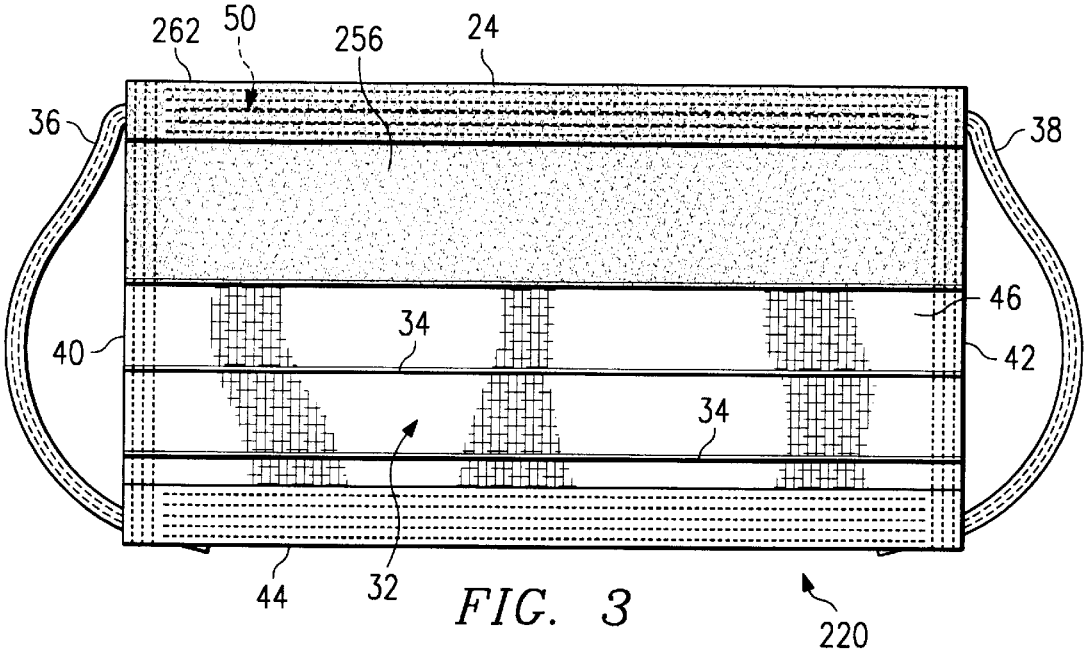
FIG. 3 is a schematic drawing showing an elevational view of the front or exterior of a face mask incorporating still another embodiment of the present invention.

Face mask 220 as shown in FIG. 3 includes filter body 32 and ear loops 36 and 38 which are essentially the same as previously described with respect to face mask 20 and 120. For the embodiment of the present invention shown in FIG. 3, face mask 220 includes first edge binding 262 extending along and folded over top edge 24. First edge binding 262 is preferably formed from darkened material to reduced glare and reflections from the exterior of face mask 220 into the eyes of wearer 22. Non-woven material layer 256 covering fluid impervious film layer 54 (not expressly shown in FIG. 3), is preferably formed from darkened material to further reduce glare and reflections from the exterior of face mask 220 into the eyes of wearer 22.

Figure 4:
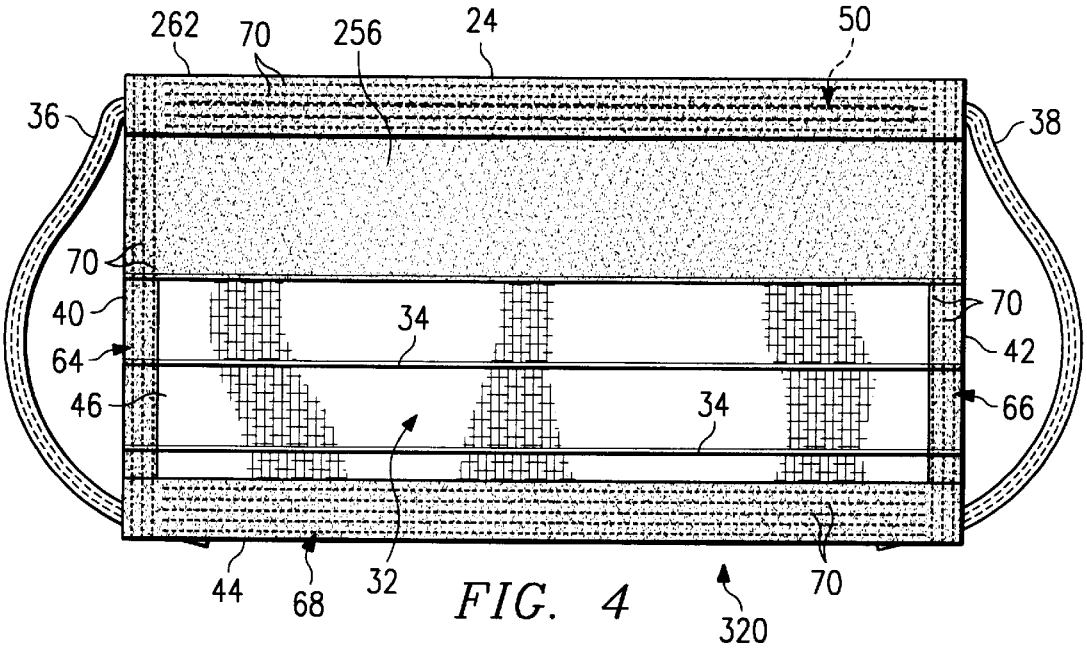
FIG. 4 is a schematic drawing showing an elevational view of the front or exterior of a face mask incorporating a further embodiment of the present invention.

Face mask 320 as shown in FIG. 4 includes filter body 32 and ear loops 36 and 38 which are similar to previously described face mask 20, 120 and 220. Face mask 320 includes first edge binding 262 formed from darkened material to reduce glare and reflections. Face mask 320 also includes non-woven material layer 256 covering fluid impervious film layer 54 (not expressly shown in FIG. 4) to reduce glare and reflections from the exterior of face mask 320 into the eyes of wearer 22. In addition, face mask 320 includes second edge binding 64 extending along and folded over side edge 40 of filter body 32. Third edge binding 66 extends along and is folded over the opposite side edge 42 of filter body 32. Fourth edge binding 68 extends along and is folded over bottom edge 44 of filter body 32.

A plurality of bonds 70 are formed between second edge binding 64, third edge binding 66 and fourth edge binding 68, and adjacent portions of filter body 32. For the embodiment shown in FIG. 4, second edge binding 64, third edge binding 66 and fourth edge binding 68 are preferably formed from darkened material to further reduce glare and reflections from the exterior of face mask 320 into the eyes of wearer 22. First edge binding 62, second edge binding 64, third edge binding 66 and fourth edge binding 68 may be formed from various types of non-woven materials including polyester.

For some applications, a second layer of fluid impervious film (not expressly shown) may be disposed upon the interior surface of filter body 32 adjacent to and extending along top edge 24. This second layer of fluid impervious film cooperates with nose piece 50 to further reduce blow by between top edge 24 and adjacent portions of the wearer's face.

Depending upon the type of material used to form fluid impervious film layer 54, and the type of bonding techniques used to attach fluid impervious film layer 54 to the upper portion of filter body 32, the use of non-woven material layer 56 may not be necessary. For these applications, fluid impervious film layer 54 is preferably provided with a tinted color and/or a matte finish to minimize reflections and glare from the exterior of the resulting face mask into the eyes of the wearer.

For some applications, a moisture barrier formed from a layer of fluid impervious film and a layer of foam material may be disposed on the interior surface of filter body 32 adjacent to top edge 24 as shown in U.S. Pat. No. 4,635,628.

The present invention has been described with respect to a surgical style face mask having a pleated filter body formed from multiple layers of material. However, the present invention may be used with face mask having a wide variety of filter bodies such as the face mask shown in U.S. Pat. No. 5,322,061 entitled "Disposable Aerosol Mask." The present invention may also be used with face mask having a filter body formed from a single layer of material which are sometimes referred to as a face veil.

Although the present invention has been described in detail with respect to alternative embodiments, various changes and modifications may be suggested to one skilled in the art, and it should be understood that various changes, substitutions, and alterations can be made hereto without departing from the spirit and scope of the invention as defined by the appended claims.

What is claimed is:

1. A face mask having a filter body for covering the nose and mouth of a wearer, the filter body having an exterior surface with a top edge, bottom edge, and opposite side edges extending therebetween, and means for securing the face mask to the wearer's face, comprising:

a layer of fluid impervious film disposed over the exterior surface of the filter body adjacent to the top edge for restricting the flow of moisture therethrough;

a layer of non-woven material in juxtaposition with and covering the layer of fluid impervious film;

the layer of fluid impervious film and the layer of non-woven material having a generally rectangular configuration corresponding with adjacent portions of the filter body;

the layer of fluid impervious film and the layer of non-woven material each having a top edge bonded with the top edge of the filter body;

the layer of fluid impervious film and the layer of non-woven material each having opposites side edges extending from the respective top edge with the side edges of the layer of fluid impervious; film and the side edges of the layer of the non-woven material bonded with adjacent portions of the side edges of the filter body;

the length of the side edges of the layer of fluid impervious film and layer of non-woven material is less than the length of the respective side edges of the filter body; and the layer of fluid impervious film and the layer of non-woven material, each having a bottom edge opposite from the respective top edge adjacent the exterior surface of the filter body and above the bottom edge of the filter body with no bonding between the respective bottom edges and the filter body to allow the passage of air between the bottom edge of the layer of fluid impervious film and adjacent portions of the filter body.

2. The face mask of claim 1 wherein the securing means further comprises a pair of ear loops attached adjacent to opposite side edges of the filter body for securing the face mask to the face of the wearer.

3. The face mask of claim 1 wherein the securing means further comprises at least two surgical ties attached adjacent to opposite side edges of the filter body for securing the face mask to the face of the wearer.

4. The face mask of claim 1 wherein the securing means further comprises at least one head band attached adjacent to opposite side edges of the filter body for securing the face mask to the face of the wearer.

5. The face mask of claim 1 further comprising a transparent visor attached adjacent to the top edge of the filter body to protect the eyes of the wearer from liquids directed from the exterior of the visor.

6. The face mask of claim 1 further comprising:

an elongated malleable member extending along the top edge of the filter body to conform the top edge of the filter body to a desired shape corresponding with the contours of the wearer's nose and face; and the malleable member having a dull, non-reflective exterior surface to minimize glare and reflections from the exterior of the face mask into the eyes of the wearer.

7. The face mask of claim 1 wherein the filter body further comprises:

an elongated malleable member secured within the filter body and extending along the top edge of the filter body to conform the top edge with the contours of the wearer's nose and cheeks;

a first edge binding extending along and folded over the top edge with a plurality of bonds between the first edge binding and adjacent portions of the filter body; and the first edge binding formed from darkened material to reduce glare and reflections from the exterior of the face mask into the eyes of the wearer.

8. The face mask of claim 7 wherein the filter body further comprises:

a second edge binding extending along and folded over one side edge of the filter body;

a third edge binding extending along and folded over the opposite side edge of the filter body;

a bottom edge of the filter body extending between the side edges opposite from the top edge;

a fourth edge binding extending along and folded over the bottom edge of the filter body;

a plurality of bonds formed between the second edge binding, the third edge binding, the fourth edge binding and adjacent portions of the filter body; and the second edge binding, the third edge binding and the fourth edge binding formed from darkened material to reduce glare and reflections from the exterior of the face mask into the eyes of the wearer.

9. The face mask of claim 1 wherein the filter body further comprises an interior surface opposite from the exterior surface with a layer of fluid impervious film extending along the top edge adjacent to the interior surface of the filter body.

10. The face mask of claim 1 wherein the filter body further comprises:

an exterior layer of material; and the layer of non-woven material covering the layer of fluid impervious film formed from the same material as the exterior layer of the filter body.

11. The face mask of claim 1 wherein the filter body further comprises:

an exterior layer of material; and the layer of non-woven material covering the layer of fluid impervious film formed from darkened material to reduce glare and reflections from the exterior of the face mask into the eyes of the wearer.

* * * * *

UNITED STATES PATENT AND TRADEMARK OFFICE

CERTIFICATE OF CORRECTION

PATENT NO. : 5,813,398 Page 1 of 2

DATED : September 29, 1998

INVENTOR(S) : Derek W. Baird, Kevin K. Brunson

It is certified that error appears in the above-indentified patent and that said Letters Patent is hereby corrected as shown below:

On title page, item [56]

The following patents were omitted from the "References Cited" section of the above-cited patent. Please add the following to said section:

| | | |
|---|---|---|
| 2,029,947 | 2/1936 | Schmitt et al. |
| 2,556,589 | 6/1951 | Duc |
| 3,170,461 | 2/1965 | Watts, Jr. |
| 3,603,315 | 9/1971 | Becker, III |
| 3,834,384 | 9/1974 | Raines |
| 3,971,369 | 7/1976 | Aspelin et al. |
| 4,596,329 | 6/1986 | Eldridge, Jr. |
| 4,606,341 | 8/1986 | Hubbard et al. |
| 4,628,927 | 12/1986 | Ward |
| 1,473,924 | 5/18/77 | Great Britain |
| 892,262 | 3/21/62 | Great Britain |
| 2,471,792 | 6/26/81 | France |

UNITED STATES PATENT AND TRADEMARK OFFICE

CERTIFICATE OF CORRECTION

PATENT NO. : 5,813,398

DATED : September 29, 1998

INVENTOR(S) : Derek W. Baird, Kevin K. Brunson

It is certified that error appears in the above-identified patent and that said Letters Patent is hereby corrected as shown below:

0,032,422 7/22/81 EPO

Signed and Sealed this

Tenth Day of August, 1999

*Attest:*

Q. TODD DICKINSON

*Attesting Officer*

*Acting Commissioner of Patents and Trademarks*